United States Patent [19]

Kinsman et al.

[11] Patent Number: 4,756,966

[45] Date of Patent: Jul. 12, 1988

[54] TRANSPARENCY FILM ASSEMBLAGE WITH PROCESSING LIQUID PAD IN ENVELOPE

[75] Inventors: Gordon F. Kinsman, Billerica; F. Richard Cottrell, South Easton, both of Mass.

[73] Assignee: Polaroid Corporation, Cambridge, Mass.

[21] Appl. No.: 75,561

[22] Filed: Jul. 20, 1987

[51] Int. Cl.[4] ..... G03C 3/00; G03D 9/00

[52] U.S. Cl. ..... 430/497; 430/206; 430/208; 430/210; 430/499; 354/303; 354/318

[58] Field of Search ..... 430/206, 208, 210, 497, 430/499; 354/303, 318

[56] References Cited

U.S. PATENT DOCUMENTS 4,443,530 4/1984 Cronin et al. ..... 430/138
4,461,556 7/1986 Douglas ..... 354/303
4,566,770 1/1986 Czumak et al. ..... 354/276
4,600,680 7/1986 Fitcher ..... 430/207

*Primary Examiner*—Richard L. Schilling
*Attorney, Agent, or Firm*—Alfred E. Corrigan

[57] ABSTRACT

A transparency film assemblage for use with a camera includes a mount with an aperture therethrough. A film frame have a photosensitive layer is bonded to the mount in a position to cover the aperture. Secured to the mount is a foil sheet folded upon itself to form a moisture impermeable envelope. Within said envelope is a foraminous pad impregnated with developing liquid. Following exposure of the film frame the envelope is opened, the pad is laminated to the photosensitive layer of the film frame and the foil sheet is refolded to encompass the mount, pad and film frame in a light impermeable envelope suitable to be ejected from the camera while film developing continues.

25 Claims, 2 Drawing Sheets

TRANSPARENCY FILM ASSEMBLAGE WITH PROCESSING LIQUID PAD IN ENVELOPE

BACKGROUND OF THE INVENTION

1. Field of the Invention

This invention relates to a transparency file assemblage of the type including instant or self-developing film.

2. Description of the Prior Art

Volumes of patents have issued with transparency film assemblages which include, as an element thereof, instant or self-developing type film. An example is U.S. Pat. No. 4,443,530 directed to a self-processing film unit including a photosensitive sheet combined with a liquid applicator pad which is applied to the sheet after its exposure to initiate processing. The applicator pad is sealed in a liquid and air impervious pocket and is affixed to one end of the photosensitive sheet. The sheet and pad combination are to be carried as a unit through a camera system.

Another example of a self-processing film unit including a sheet-like photosensitive film component in combination with an attached pad impregnated with film processing fluid is in U.S. Pat. No. 4,461,556. The disclosure is directed to unique structure for applying the pad to the sheet of photosensitive film subsequent to its exposure and includes moving the unit through a pair of spaced apart rollers to laminate the pad to the photosensitive sheet. A coil of opaque material is separately mounted in the film assemblage to engage and cover the film unit during its developing period.

U.S. Pat. No. 4,600,680 reveals a transparency film assemblage which includes a film mount in two sections and a film frame of the instant type mounted in one section. After exposure of the film, a container of processing liquid mounted adjacent the film frame is ruptured and processing liquid is spread over the film frame. An opaque strip sheet covers one side of the film frame to hold the processing liquid against the film frame during the processing. Subsequently, the strip sheet is stripped away and folded into a cavity in the mount as the two parts of the film mount are folded together and bonded to hold the developed film frame in position.

An example of a processing unit where the processing fluid is not incorporated as a part of the film assemblage per se is U.S. Pat. No. 4,566,770. In the processing sequence, laminating rollers are used to join a pad impregnated with processing fluid to an exposed film frame and at least one of the rollers is structured to traverse a sloping ramp extending between the elevated surface of the mount for the film frame and the surface of the film frame itself. The sloping ramp at each end of the aperture holding the film frame allows for an easy sloping transition of the roller from the mount to the surface of the film frame.

What is needed in the industry is a transparency film assemblage to be used in combination with a camera where a premounted slide is combined with film developing chemicals whereby, after the film is exposed, the photodeveloping chemicals can be applied directly to the film frame while the film frame and its mount are encapsulated in a light impermeable envelope which can be discharged to the ambient light where it will develop and the enclosing envelope subsequently stripped and discarded to leave the finished slide ready for immediate viewing.

SUMMARY OF THE INVENTION

This invention has filled said need by a unique combination of a premounted slide with an attached encapsulated photographic reagent pad-pod.

A foraminous pad impregnated with photographic processing liquid is enclosed in a foil envelope. The foil envelope is formed by folding a single sheet of foil and sealing the foil along its marginal edges and transversely along its open end so that the edge seals in combination with the transverse seal and the fold create a fluid and light impermeable envelope. The envelope is then adhesively bonded to a mount along its trailing edge and with the folded edge of the envelope adjacent the leading edge of the mount.

Tabs which project transversely from the transversely sealed end of the folded sheet may be grasped mechanically after exposure of the film frame in the mount. The tabs are designed to be grasped by mechanical means and pulled forward to break the releasable seal around the impregnated pad so that said pad can be moved into contact with the underside of the film frame. An emulsion layer of photosensitive material on the underside of the film frame will react with the developing liquid of the pad to form an image on the film frame. After the tabs have been pulled to their maximum extent, the mount will be passed through a pair of rollers having parallel axes which will serve to fold the unfolded portion of the foil back over the leading edge of the mount and onto top of the mount. The rollers will laminate the foil to the mount thereby providing a light and air tight envelope which may be ejected from the camera where the developing process can continue in ambient light. After a suitable period of time, the encapsulating envelope of foil material may be stripped from the mount and discarded, leaving the finished slide for immediate use.

Objects of the invention not clear from the above will be understood by a review of the drawings and the detailed description of the preferred embodiment which follow.

and

Figure 7:
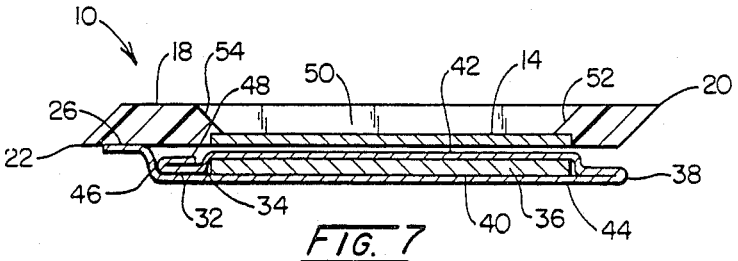
FIG. 7 is a sectional view taken along line 7—7 of FIG. 1.
Figure 8:
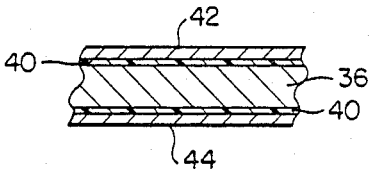

FIG. 8 is an enlargement of the pad area of FIG. 7.

DESCRIPTION OF THE PREFERRED EMBODIMENT

A transparency film assemblage of unique structure is adapted to be mounted in a camera for exposure and subsequently manipulated inside the camera to contact the exposed film frame with a photographic processing liquid impregnated pad while sealing the film frame in a light impervious foil envelope which is then ejected from the camera into ambient light where the processing proceeds for a predetermined period of time, e.g., ten seconds to four minutes depending upon the type of film being processed. Subsequently, the foil envelope may be manually stripped from the processed slide and safely discarded. The developed film frame is immediately ready for viewing.

Figure 1:
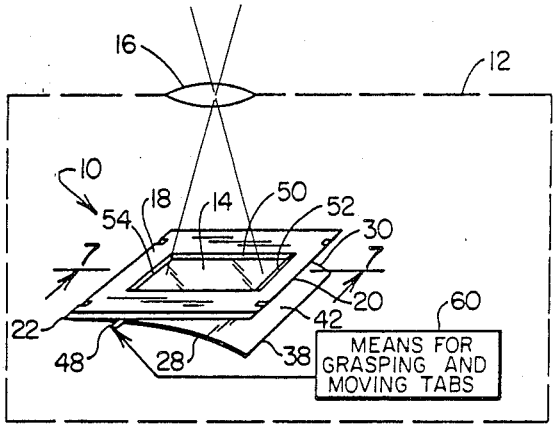
FIG. 1 is a perspective view of a film assemblage according to this invention in a camera which is shown in phantom.

The illustrated film assemblage 10, FIGS. 1 and 7, is shown mounted in a camera 12 (shown in phantom) and is oriented to expose a film frame 14 through a lens 16.

Looking to FIG. 7, the film frame 14 is bonded to a mount 18 having a leading edge 20 and a trailing edge 22.

The film frame is conventional in the context of being of the instant or self-developing type transparency film and it is adhesively secured to the underside of the mount (as seen in Fig. 7). The film frame may include a plurality of layers including, in sequence, from the top (lens facing) layer to the bottom layer, the following: a layer of transparent material such as Mylar, an additive color screen, an image-receiving layer, a stripping layer, and a photosensitive emulsion layer.

Adhesively secured to the mount at 26 is a single sheet of lead or aluminum foil folded upon itself at 38 and sealed along its marginal edges at 28 and 30 and traversely at 32 to provide a liquid, air and light impermeable enclosure 34 to hold a reagent pad 36. The reagent pad 36 is a foraminous material which is impregnated with an aqueous, alkaline, photographic processing composition specifically intended to react with the photosensitive layer on the film frame 14 after the film frame has been exposed to light. The mechanism for accomplishing this desired result will be explained subsequently.

It will be observed that the folded edge 38 of the foil is located adjacent the leading edge 20 of the mount 18, also for reasons which will be explained subsequently.

To facilitate the bonding of the foil sheet along its marginal edges 28, 30 and 32 and to increase the storage life of the photographic processing liquid in the reagent pad 36, one side of the foil is coated with a layer of polyvinylchloride 40, best seen in FIG. 8. Note that the polyvinylchloride layer is on the side of the foil in direct contact with the pad 36 to minimize reaction between the metallic foil and the processing liquid. In addition, the layer 40 is on the side which is to be sealed. The polyvinylchloride is susceptible to heat sealing and this physical characteristic is used in this environment.

The folded foil includes an upper portion 42 and a lower portion 44. Note that the lower portion 44 is the portion adhesively bonded at 26 to the mount 18. On the other hand, the upper portion 42 is loose and folded back upon itself at the trailing edge 46. Projecting transversely from this trailing edge 46 are a pair of tabs 48. The tabs serve as places easy to be grasped by mechanical means 60 within a camera. These mechanical means may strip the upper portion 42 from the pad 36 to allow said pad to contact the photosensitive emulsion coated side of the film frame 14. It will be noted that the pad is specifically designed to be of a shape and size substantially coextensive with the shape and size of the film frame held in aperture 50. While the aperture is shown as rectangular in the embodiment illustrated, it is quite clear that the pad may be cut to accomodate any particular aperture configuration.

Figure 4:
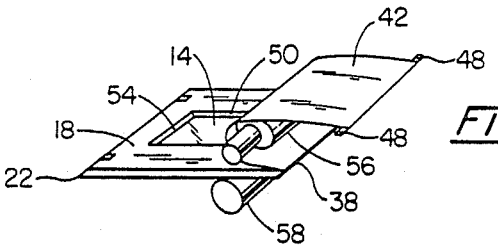
FIG. 4 is a perspective view of the film assemblage of FIG. 1 being passed through rollers inside the camera to seal the film frame in an light impervious envelope.

Observing FIGS. 4 and 7, it will be noted that the periphery of the aperture 50 nearest the leading edge 20 and the trailing edge 22 of the mount are sloped to form ramps 52 and 54 which descend from and ascend to, respectively, the upper surface of the mount. The purpose is to facilitate the smooth descent and ascent by a top roller 56 into the aperture. Said top roller 56 is cooperating with a bottom roller 58 to fold the upper portion 42 of the foil around the leading edge 20 of the mount and laminate the foil to the mount for creating an envelope, see FIG. 5.

Observing again FIG. 4, it will be noted that the cylindrical bottom roller 58 extends the full width of the mount 18 while on the other hand, the upper or top roller 56 has end portions of reduced diameter. The transverse length of the cylindrical top roller coincides substantially with the transverse width of the aperture 50 and this allows the top roller to glide down ramp 52 and press the upper portion 42 of the foil into engagement with the upper surface of the film frame 14 and thereby, in combination with roller 58, compress the pad 36 more firmly against the emulsion coating and to enhance the laminating effect to create the light impervious envelope to be ejected from the camera.

Figure 2:
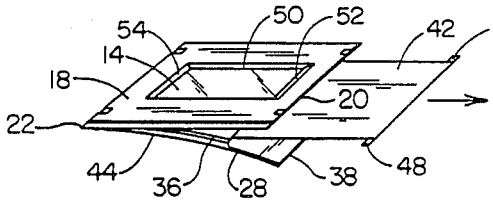
FIG. 2 is a perspective view of the film assemblage of FIG. 1 with the envelope containing the photographic processing liquid partially opened.
Figure 3:
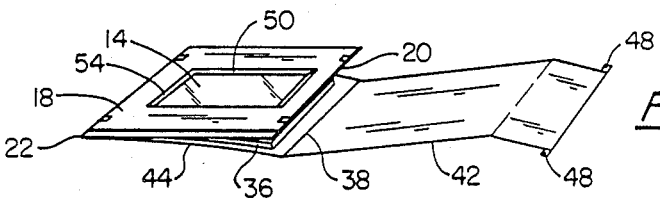
FIG. 3 is a perspective view of the film assemblage of FIG. 1 with the envelope of processing liquid completely open.

As best seen in FIGS. 2–4, the width of the foil sheet is about the same width as the mount 18 but it is critical that its width be greater than the width of the aperture 50 for reasons which are obvious. Additionally, the length of the sheet is more than twice the length of the mount so that the tab end 48 of the foil sheet will extend beyond the trailing edge 22 of the mount to allow easy manual gripping when it is desired to strip the sheet of foil from the finished slide.

In operation, the film assemblage 10 is mounted in a camera 12 and the film frame 14 is exposed through lens 16. Then mechanical means 60 will grasp tabs 48 and pull them forward as illustrated in FIG. 2 until the envelope enclosing the pad 36 is completely open as shown in FIG. 3 to thereby allow the pad and its photographic processing liquid access to the photosensitive layer on the underside of the exposed film frame 14.

Figure 5:
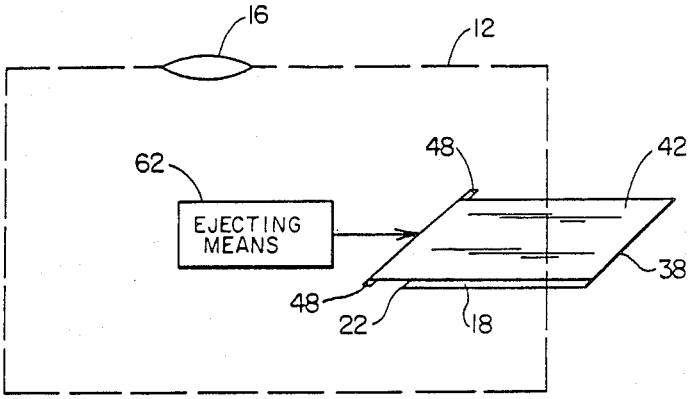
FIG. 5 is a perspective view of the encapsulated film frame as it is ejected from the camera for further developing.
Figure 6:
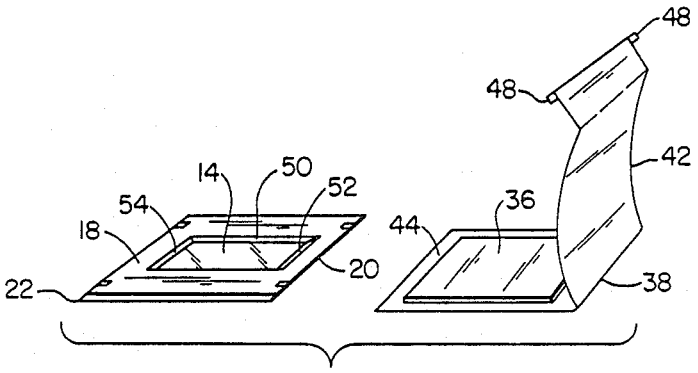
FIG. 6 is an exploded view of a finished slide with the encapsulating envelope separated by hand to be discarded.

After the means 60 for grasping and moving the tabs have completely extended the foil sheet, the mount 18 is passed through rollers 56 and 58 to thereby fold the top portion 42 of the foil around the leading edge 20 of the mount and back over the top or upper surface of the mount and film frame. The purpose of the rollers is to laminate the foil sheet to both the top and bottom of the mount, press the pad 36 firmly against the emulsion layer to enhance uniform film development and simultaneously create a light impervious envelope which may be ejected from the camera as illustrated in FIG. 5. The light impervious envelope allows the photographic developing process to continue in the ambient light for from ten seconds to four minutes, depending upon the type of film being processed, at which time the sheet of foil and the pad 36 may be hand stripped from the finished slide and discarded as illustrated in FIG. 6. During this stripping, the aforementioned photosensitive emulsion layer and stripping layer of the film frame 14 stay with the pad 36 because the former exhibits a greater adhesiveness to the pad 36 than the latter (stripping layer) does to the frame's image-receiving layer.

Having thus described the invention in its preferred embodiment, it will be clear that modifications may be made to the structure without departing from the spirit of the invention. Additionally, the language used and the drawings are for illustrative purposes only and it is not intended that they be limiting on the invention. Rather, it is intended that the invention be limited only by the scope of the appended claims.

I claim:

1. A transparency film assemblage, comprising:

a mount having a generally rectangular periphery, said mount including a leading edge and a trailing edge, means forming an aperture in said mount, said aperture having a length and a width, a film frame secured to said mount covering said aperture, one side of said film frame bearing a photosensitive layer, a generally rectangular sheet of foil folded on itself to form a moisture impermeable envelope, said sheet being releasibly sealed to itself along three of its facing marginal edges, thereby forming said envelope, a foraminous pad enclosed within said envelope, said pad being impregnated with a photographic processing liquid, said liquid being reactive with said photosensitive layer to form an image in said film frame after said film has been exposed to light, said foil sheet having an edge most remote from said folded edge, said remote edge being secured to said mount adjacent said trailing edge of said mount and with the enclosed pad adjacent to said aperture on the side of said film frame bearing said photosensitive layer, said pad having a shape and size to substantially cover said film frame, said foil sheet including upper and lower portions while in folded condition, said upper portion being nearest to said film frame, said lower portion of said sheet including said most remote edge which is secured to said mount, means on said upper portion of said foil sheet to grasp for:

(a) breaking said releasable seal, (b) stripping said upper portion of said foil sheet from between said pad and said film frame, and (c) assisting in wrapping said upper portion of said foil sheet around said leading edge and over said aperture to completely enclose said film frame in a light impermeable envelope for a time appropriate to allow said photosensitive layer and said photographic processing liquid to cooperatively form an image in said film frame while said light impermeable envelope prevents undesirable exposure to light.

2. The transparency film assemblage of claim 1 wherein said means to grasp comprises tab means on said upper portion of said folded foil sheet, said tab means being located between one of said sealed marginal edges and said most remote edge secured to said mount.

3. The transparency film assemblage of claim 1 wherein said means to grasp comprises a pair of tabs, one said tab extending transversely from said upper portion of said foil sheet beyond each of two of said sealed marginal edges which do not intersect.

4. The transparency film assemblage of claim 3 including a downwardly sloping ramp at the edge of said aperture nearest said leading edge of said mount to provide for a smooth descent of a laminating roller into said aperture during formation of said light impermeable envelope, an upwardly sloping ramp at the edge of said aperture nearest said trailing edge of said mount to provide for a smooth ascent of said laminating roller from said aperture.

5. The transparency film assemblage of claim 4 wherein said foil sheet is of a length great enough that when said foil encloses said film frame in a light impermeable envelope said upper portion of said foil sheet projects beyond said trailing edge of said mount.

6. The transparency film assemblage of claim 2 including a downwardly sloping ramp at the edge of said aperture nearest said leading edge of said mount to provide for a smooth descent of a laminating roller into said aperture during formation of said light impermeable envelope, and an upwardly sloping ramp at the edge of said aperture nearest said trailing edge of said mount to provide for a smooth ascent of said laminating roller from said aperture.

7. The transparency film assemblage of claim 6 wherein said foil sheet is of a length great enough that when said foil encloses said film frame in a light impermeable envelope said upper portion of said foil sheet projects beyond said trailing edge of said mount.

8. The transparency film assemblage of claim 1 including a downwardly sloping ramp at the edge of said aperture nearest said leading edge of said mount to provide for a smooth descent of a laminating roller into said aperture during formation of said light impermeable envelope, and an upwardly sloping ramp at the edge of said aperture nearest said trailing edge of said mount to provide for a smooth ascent of said laminating roller from said aperture.

9. The transparency film assemblage of claim 8 wherein said foil sheet is of a length great enough that when said foil encloses said film frame in a light impermeable envelope said upper portion of said foil sheet projects beyond said trailing edge of said mount.

10. The transparency film assemblage of claim 1 wherein said foil sheet is of a length great enough that when said foil encloses said film frame in a light impermeable envelope said upper portion of said foil sheet projects beyond said trailing edge of said mount.

11. The transparency film assemblage of claim 2 wherein said foil sheet is of a length great enough that when said foil encloses said film frame in a light impermeable envelope said upper portion of said foil sheet projects beyond said trailing edge of said mount.

12. The transparency film assemblage of claim 3 wherein said foil sheet is of a length great enough that when said foil encloses said film frame in a light impermeable envelope said upper portion of said foil sheet projects beyond said trailing edge of said mount.

13. The transparency film assemblage of claim 1 wherein said foil sheet is at least partially composed of material selected from the group consisting of lead and aluminum and coated on one side with polyvinylchloride, said coated side of said foil sheet being in direct contact with said pad in said moisture impermeable envelope.

14. The transparency film assemblage of claim 2 wherein said foil sheet is at least partially composed of material selected from the group consisting of lead and aluminum and coated on one side with polyvinylchloride, said coated side of said foil sheet being in direct contact with said pad in said moisture impermeable envelope.

15. The transparency film assemblage of claim 3 wherein said foil sheet is at least partially composed of material selected from the group consisting of lead and aluminum and coated on one side with polyvinylchloride, said coated side of said foil sheet being in direct contact with said pad in said moisture impermeable envelope.

16. The transparency film assemblage of claim 4 wherein said foil sheet is at least partially composed of material selected from the group consisting of lead and aluminum and coated on one side with polyvinylchloride, said coated side of said foil sheet being in direct contact with said pad in said moisture impermeable envelope.

17. The transparency film assemblage of claim 5 wherein said foil sheet is at least partially composed of material selected from the group consisting of lead and aluminum and coated on one side with polyvinylchloride, said coated side of said foil sheet being in direct contact with said pad in said moisture impermeable envelope.

18. The transparency film assemblage of claim 6 wherein said foil sheet is at least partially composed of material selected from the group consisting of lead and aluminum and coated on one side with polyvinylchloride, said coated side of said foil sheet being in direct contact with said pad in said moisture impermeable envelope.

19. The transparency film assemblage of claim 7 wherein said foil sheet is at least partially composed of material selected from the group consisting of lead and aluminum and coated on one side with polyvinylchloride, said coated side of said foil sheet being in direct contact with said pad in said moisture impermeable envelope.

20. The transparency film assemblage of claim 8 wherein said foil sheet is at least partially composed of material selected from the group consisting of lead and aluminum and coated on one side with polyvinlychloride, said coated side of said foil sheet being in direct contact with said pad in said moisture impermeable envelope.

21. A transparency film assemblage comprising:

a mount for supporting a film frame, said mount including a leading edge, a trailing edge, and means for forming an aperture in said mount;

a film frame secured to said mount in alignment with said aperature;

a sheet of moisture impermeable material folded on itself to define upper and lower portions and having marginal edges releasably sealed to form a moisture impermeable envelope, said sheet having a first end located adjacent to said upper portion and a second end located adjacent to said lower portion and being secured to said trailing edge of said mount;

a pad fully enclosed within said moisture impermeable envelope located in alignment with said film frame and separated therefrom by said upper portion of said sheet, said pad carrying a photographic processing liquid; and means on said first end of said sheet adapted to be grasped by a member of a camera, subsequent to the photographic exposure of said film frame, for removing said upper portion from between said pad and said film frame prior to moving said film assemblage between a pair of pressure-applying members located in the camera in a manner which presses said pad into firm engagement with said film frame to initiate the formation of a visible image within said film frame.

22. A transparency film assemblage as defined in claim 21 wherein said sheet is opaque and said upper portion of said sheet is adapted to be moved into a position on the opposite side of said mount from that of said lower portion, during passage between the pressure-applying members, to form with said lower portion and said mount a lighttight envelope thus enabling said film assemblage to be moved to the exterior of the camera without adversely subjecting the developing image in said film frame to further photographic exposure by the ambient light.

23. A transparency film assemblage as defined in claim 22 wherein said sheet is of a length great enough that when said sheet encloses said film frame in a lighttight envelope said first end of said sheet projects beyond said trailing edge of said mount.

24. A transparency film assemblage as defined in claim 22 wherein said sheet is at least partially composed of material selected from a group consisting of lead and aluminum.

25. A transparency film assemblage as defined in claim 24 wherein said sheet is coated on one side with polyvinylchloride, said coated side being in direct contact with said pad when said pad is enclosed by said sheet.

* * * * *